United States Patent [19]

Lyman

[11] Patent Number: 4,909,465

[45] Date of Patent: Mar. 20, 1990

[54] SHELF CLIP

[75] Inventor: Leon B. Lyman, Enumclaw, Wash.

[73] Assignee: Ly-Line Products, Enumclaw, Wash.

[21] Appl. No.: 292,220

[22] Filed: Dec. 28, 1988

[51] Int. Cl.[4] ..... A47G 29/02

[52] U.S. Cl. ..... 248/250; 108/108

[58] Field of Search ..... 248/239, 243, 247, 248, 248/250; 108/108, 109

[56] References Cited

U.S. PATENT DOCUMENTS

| | | | |
|---|---|---|---|
| 892,542 | 7/1908 | Peacock | 248/248 |
| 3,207,100 | 9/1965 | McMaster | 248/250 |
| 3,471,112 | 10/1969 | MacDonald | 248/250 |
| 3,759,191 | 9/1973 | Freeman | 248/239 |
| 3,779,392 | 12/1973 | Betts . | |
| 3,945,595 | 3/1976 | Schlueter | 248/239 |
| 4,037,813 | 7/1977 | Loui | 248/250 |
| 4,053,132 | 10/1977 | Del Pozzo | 108/109 |
| 4,094,483 | 6/1978 | Busch . | |
| 4,432,523 | 2/1984 | Follows | 248/250 |
| 4,619,428 | 10/1986 | Bailey . | |
| 4,666,117 | 5/1987 | Taft | 248/250 |
| 4,732,358 | 3/1988 | Hughes | 108/108 |
| 4,735,325 | 4/1988 | Remmers | 248/250 |

FOREIGN PATENT DOCUMENTS

| | | | |
|---|---|---|---|
| 205092 | 11/1956 | Australia | 108/109 |
| 1283148 | 12/1961 | France | 248/239 |
| 2398 | of 1908 | United Kingdom | 248/248 |
| 1540224 | 2/1979 | United Kingdom | 248/250 |

*Primary Examiner*—Ramon O. Ramirez
*Assistant Examiner*—Robert A. Olson
*Attorney, Agent, or Firm*—Seed and Berry

[57] ABSTRACT

A shelf clip for removably mounting a shelf on a wall, bookcase or the like. The shelf clip has two mounting posts extending rearwardly from an upstanding member for insertion into a pair of holes in the mounting wall. Retaining members extend from the front face of the upstanding member and are spring biased into an outward position. The retaining members include sharp ridges for engaging the edgewall of the shelf. When a shelf is placed on the clip, a force exerted by the shelf on the retaining members displaces them backwards towards the mounting wall and at least partially into a pair of slots formed in the upstanding member behind the retaining members. This creates a force on the upper mounting post to more firmly seat the post into the mounting wall hole and causes the retaining members to securely bit into the shelf edgewall. The retaining members have a shaped knife-like edge to prevent lateral movement of the shelf.

20 Claims, 2 Drawing Sheets

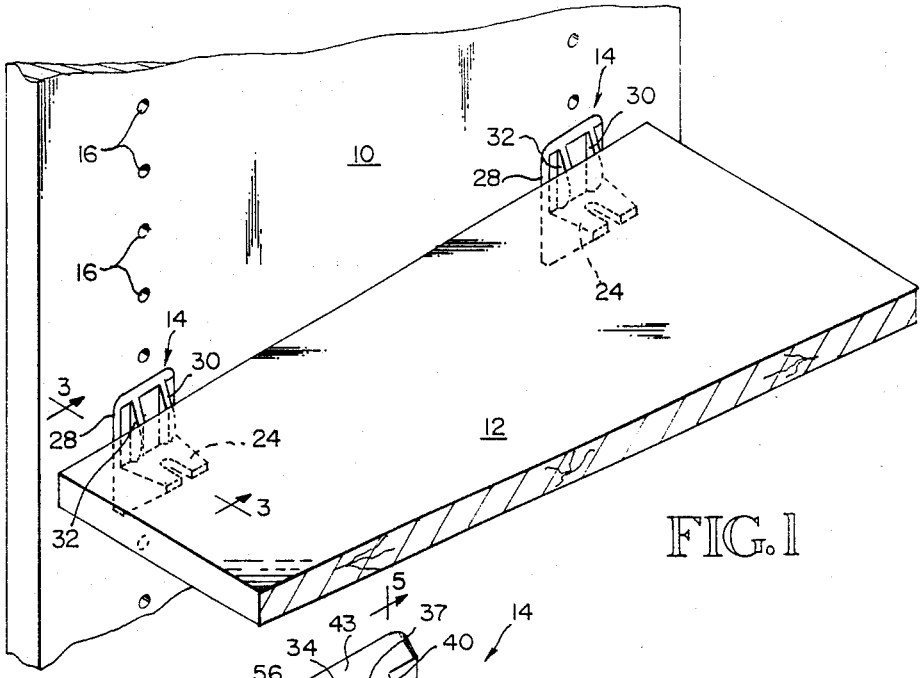
FIG. 1
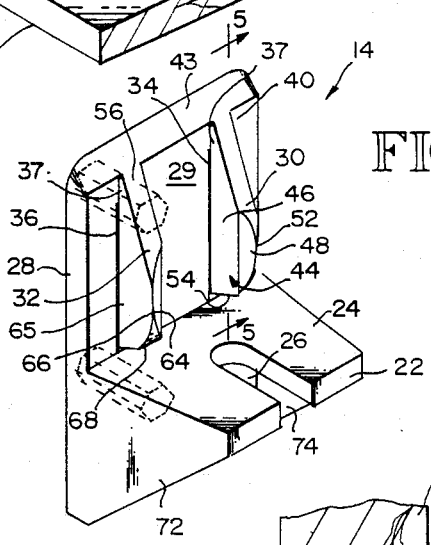
FIG. 2
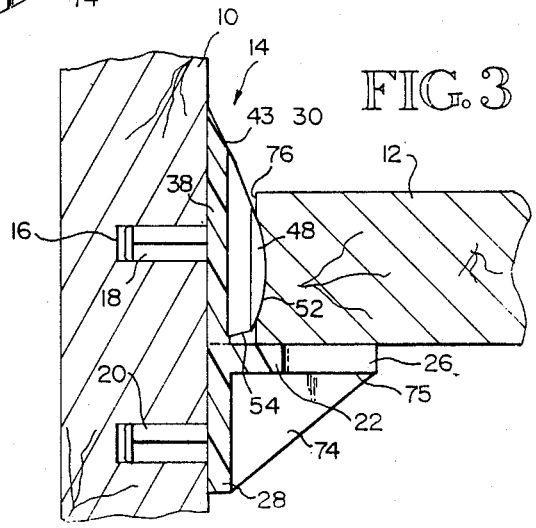
FIG. 3
FIG. 4
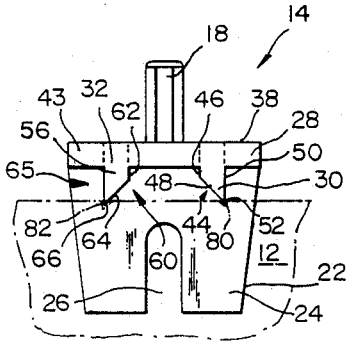

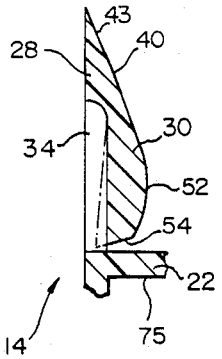
FIG. 5
FIG. 6
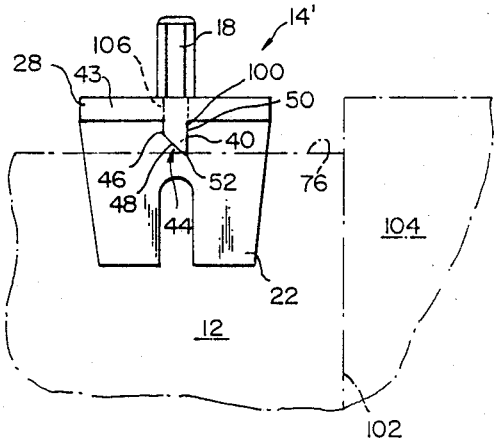

SHELF CLIP

TECHNICAL FIELD

This invention relates to a shelf clip for mounting on a shelf, and more particularly, to a shelf clip which restrains shelf movement in a horizontal plane.

BACKGROUND OF THE INVENTION

Shelves are used frequently in the home and office for supporting items such as: books, clocks, dishes, photographs, ornaments, stereos, televisions and the like thereon. Shelves are often mounted by supporting them at each end between a pair of spaced apart supporting walls facing toward each other using shelf clips removably attached to the support walls. It is often desirable that the shelf be movable to different positions, rather than be permanently fixed in a single position between the support walls.

There are many shelf clips for permitting a shelf to be mounted between two facing support walls and then moved to a different position with relative ease. Presently available shelf clips typically have a horizontally extending support member and a single mounting post extending rearward for positioning in one of a series of holes in the support wall. Numerous holes are formed extending vertically along the support walls into which the shelf clip may be placed to permit the shelf to be held at a variety of different elevational positions. The shelf is placed on the horizontal support members of the shelf clips and held in position by its own weight, combined with the weight of any items that may be placed thereon.

One disadvantage of mounting a shelf using presently available shelf clips is that when a book or other object is slid forwardly and off of the shelf, the shelf may slide along with the item. The shelf may slide so far that it pulls clear of one or more of the shelf clips and becomes unbalanced, causing the shelf and the items thereon to fall.

A further disadvantage of mounting a shelf with such a shelf clip is that the clip moves back and forth or up and down a short distance each time an item is placed on or removed from the shelf. This causes the hole into which the mounting post extends for retaining the shelf clip to be enlarged over time. This can also result from the placement of excessive weight on the shelf even if it simply sits stationary on the shelf. As the hole becomes larger, the movement of the shelf clip increases in the hole. The hole may become so enlarged or misshaped that it will no longer retain the shelf clip, causing the shelf and the items thereon to fall. When this occurs, the shelf must be mounted at a different elevational position since the hole has been enlarged or misshapen to a degree that it will no longer reliably retain the shelf clip.

DISCLOSURE OF THE INVENTION

It is therefore an object o this invention to provide a shelf clip which prevents forward movement of the shelf, but which still permits the shelf to be easily removed.

It is an object of this invention to provide a shelf clip having two mounting posts extending into respective holes in the supporting wall with both posts being firmly held seated in position by a force exerted by the shelf itself.

It is another object of this invention to provide a method of mounting a shelf in such a way that the shelf is easily removable, yet firmly held in position during use.

These and other objects of the invention are, as will be apparent herein, accomplished by providing a shelf clip having a horizontal support member and a retaining member resiliently biased against a shelf. The retaining member is an integral part of the shelf clip. Two mounting posts extend from the back of the shelf clip and into mounting holes of a support wall. The two mounting posts are spaced apart from each other, one mounting post being below the horizontal support member and the other being aligned immediately behind the retaining member to minimize rotational movement of the clip when sliding items on or off the shelf. The retaining members are vertically oriented and sloped along an upwardly facing surface to permit a shelf to be smoothly placed on or removed from the horizontal support member from above the shelf clip. The retaining members include a sharp edge for grasping the shelf to ensure that the shelf cannot move forward. A force is exerted by the shelf on the retaining member which acts to hold the mounting post positioned immediately behind the retaining member into the support wall.

BRIEF DESCRIPTION OF THE DRAWINGS

FIG. 1 is an isometric view of two shelf clips of the present invention shown in use supporting a shelf.

FIG. 2 is an enlarged isometric view of the shelf clip of FIG. 1.

FIG. 3 is an enlarged cross-sectional view taken substantially along the line 3—3 of FIG. 1.

FIG. 4 is a top plan view of the shelf clip of FIG. 3.

FIG. 5 is a cross-sectional view taken substantially along line 5—5 of FIG. 2.

FIG. 6 is a top plan view of an alternative embodiment of the invention having only a single retaining member.

BEST MODE FOR CARRYING OUT THE INVENTION

As shown in FIG. 1, a vertical mounting wall 10 supports a pair of retaining shelf clips 14 according to the present invention, for holding a shelf 12. The mounting wall 10 has two vertically aligned series of spaced apart holes 16 therein. The two shelf clips 14 support one end of the shelf 12 and an opposed wall (not shown) facing the mounting wall 10 is provided with another pair of shelf clips (not shown) for holding up the other end of the shelf. The mounting walls may be any pair of facing vertical walls between which the shelf 12 is to extend, such as bookcase sidewalls, china cabinet walls, walls built into a home and the like.

Adjacent one of the holes 16 in each series of holes are equally spaced apart by an amount equal to the distance between upper and lower mounting posts 18 and 20, respectively, of the shelf clip 14 and each has a diameter to snugly receive one of the posts therein, which is best shown in FIG. 3.

As shown in FIG. 2, the shelf clip 14 includes a horizontal shelf support member 22 having an upper surface 24 and an open ended slot 26 extending fully therethrough. The shelf 12 rests on top of the upper surface 24 of the shelf support member 22 and a fastener (not shown) having a larger head than the width of the slot 26 may have its threaded shank screwed into the shelf 12 through the slot until the screw head is snug against a lower surface 25 of the shelf-support member to prevent the shelf from being removed from the shelf clip, if desired. The use of a fastener is undesirable, however, because of the time and difficulty of installing it and removing it should the elevational position of the shelf 12 need to be changed.

To avoid the need to use a fastener, the shelf clip 14 of the present invention also includes a pair of retaining members 30 and 32 projecting from a front face 29 of an upright member 28. The function of the retaining members will be described in more detail below. The upper and lower mounting posts 18 and 20 project rearwardly from a back face 38 of the upright member 28. The mounting posts 18 and 20 are spaced sufficiently apart from each other to prevent the clip from twisting or moving during use when positioned in two adjacent holes 16 of the mounting wall 10. The upper mounting post 18 is positioned directly behind the retaining members 30 and 32. The lower mounting post 20 is positioned below the shelf support 22.

The upright member 28 further includes a pair of elongated slots 34 and 36, with the slot 34 positioned immediately behind the retaining member 30 and the slot 36 positioned immediately behind the retaining member 32. The slots 34 and 36 extend almost the full length of the retaining members 30 and 32, and beyond the lower end of each, and have a width larger than the width of the correspondingly positioned retaining member. The retaining members 30 and 32 are resiliently attached to the upright member 28 at only an upper end 37 and are disconnected from the upright member along the remainder of their periphery to permit the retaining members to resiliently flex toward the upright member 28 and partially into the slots 34 and 36 under the force applied by the shelf 12 when the shelf clip 14 is in use, as shown in FIG. 5 for retaining member 30. The slots 34 and 36 extend completely through the upright member 28 from the front face 29 to the back face 38.

The shelf support member 22 is attached to the upright member 28 by its one end and projects forwardly therefrom and terminates in a free end.

Retaining members 30 and 32 are molded as an integral part of upright member 28, as best shown in FIGS. 2 and 5. The retaining member 30 includes an upwardly facing sloped surface 40 which faces outwardly and slopes downwardly away from the upright member 28. The sloped surface 40 is positioned adjacent to an upwardly facing edgewall 43 of the upright member 28 which faces outwardly and slopes downwardly. The sloped surface 40 and the edgewall 43 have substantially the same slope and are substantially coplanar. Retaining member 30 further includes an inside facing surface 44 facing toward the retaining member 32 and an outside facing surface 50 (see FIG. 4). The inside facing surface 44 includes a flat portion 46 and a laterally sloped portion 48. The sloped portion 48 is inclined from the inside facing surface 44 towards the outside facing surface 50, as own in FIG. 4 to define a sharp knife-like edge 52 extending generally vertically along the most forward projecting portion of the retaining member 30. The retaining member 30 has a bottom surface 54 paced above the upper surface 24 of shelf supporting member 22.

Retaining member 32 is shaped similar to retaining member 30 except it is the mirror image thereof. That is, retaining member 32 has an upwardly facing sloped surfaces 56 which faces outwardly and slopes downwardly away from the upright member 28 Retaining member 32 further includes an inside facing surface 60 facing towards the retaining member 30 and an outside facing surface 65. The inside facing surface 60 includes a flat portion 62 and a laterally sloped portion 64. A sharp knife-like edge 66 extends generally vertically along the most forward projecting portion of retaining member 32. Retaining member 32 has a bottom surface 68 spaced above the top surface 24 of the shelf support member 22.

A pair of gussets 72 and 74 are attached to the front face 29 of the upright portion 28 at a position below the shelf support member 22 and are attached to an underside 75 of the shelf support member to provide rigidity and support thereto, as best shown in FIG. 3.

The use and operation of the shelf clip 14 will now be described. Usually, four of the support clips 14 will be provided to support the shelf 12, two at each end with one located toward each corner of the shelf. Two of the shelf clips 14 are mounted onto each of the two opposed mounting walls 10 by inserting the posts 18 and 20 of each clip into a pair of the mounting holes 16 corresponding to the vertical elevation desired for the shelf 12 prior to placing the shelf thereon.

The length of the shelf 12 used is selected to be less than the distance between the opposed mounting walls 10 by an amount at least equal to the total width of the two upright members 28 of the shelf clips mounted on either side thereof, but no more than an additional amount equal to twice the width of the retaining members 30 and 32. In other words, the length of shelf 12 is selected to be short enough to ensure that the shelf end walls 76 positioned at the shelf clips 14 engages the retaining members 30 and 32 of each respective shelf clip to apply a rearward force thereon tending to depress the retaining members at least partially into the slots 34 and 36 positioned therebehind and cause the sharp knife-like edges 52 and 66 of each retaining members to bite or cut into the end wall engaged.

When placing the shelf 12 onto the mounting clips 14, the shelf is held above the mounting clips and lowered into position. The shelf 12 may first contact the outwardly and downwardly sloped edgewall 43 or the sloped surfaces 40 and 56 of retaining members 30 and 32, respectively. As the shelf 12 is pressed downward, the shelf end wall 76 will slide down these surfaces and engage the sharp knife-like edges 52 and 66 of the retaining members 30 and 32, and thereby apply a progressively increasing rearward force on the retaining members in the direction of the upright member 28. This is because of the outward and downward sloping shape of the sloped surfaces 40 and 56. The slope of the edgewall 43 and the sloped surfaces 40 and 56 also permit smooth placement and removal of the shelf.

The cutting engagement of the shelf end walls 76 by the sharp knife-like edges 52 and 66 of the retaining members 30 and 32 as the shelf 12 firmly rests on support member 22, as best shown in FIG. 3, prevents lateral movement of the shelf relative to the shelf clips 14 (i.e., forward or rearward movement of the shelf relative to a person standing in front of the shelf and placing items on, or removing items from, the shelf). As best shown in FIG. 4, the force applied by the shelf 12 on the retaining members 30 and 32 as the shelf is pressed down into a resting position on the upper surface 24 of the shelf clips 14, causes the sharp knife-like edges 52 and 66 to cut into the end wall 76 of the shelf and form two grooves 80 and 82 in the shelf end wall. If lateral force is exerted on the shelf 12 in a direction from the retaining member 32 toward the retaining member 30 (a rearward movement with respect to the person in front of the shelf as in FIG. 1), the sharp knife-like edge 66 of retaining member 32 primarily holds the shelf end wall 76 to prevent lateral movement of the shelf. Similarly, if the lateral force is exerted in direction from the retaining member 30 toward the retaining member 32 (a forward movement with respect to the person in front of the shelf), the sharp knife-like edge 52 primarily holds the shelf end wall against lateral movement of the shelf. Although in each instance the other sharp knife-like edge will also help hold the shelf against lateral movement, the laterally sloping portions 48 and 64 are less able to firmly grasp the end wall 76.

As a result of the resilient attachment of the retaining members 30 and 32 by their upper ends 37 to the upright member 28, the retaining members are resiliently biased outward with a relatively strong force when the shelf 12 is in place to firmly engage the shelf end wall 76. This biasing force is a reactionary force produced in response to the shelf 12 pressing the retaining members 30 and 32 toward the upright member 28. In the embodiment shown, the retaining members 30 and 32 are resiliently biased outward by molding the resilient members as an integral part of the shelf clip 14 using a plastic material. The plastic material is selected with sufficient flexibility to permit the retaining members 30 and 32 to be partially deflected into the slots 34 and 36, but have the structural strength and resiliency to bias the retaining members towards returning to their original position outside of the slots when the shelf is removed. A plastic material has been found suitable for this purpose, however, various types of metal or wood may also have sufficient inherent resiliency to be useful.

The retaining members 30 and 32 project perpendicularly from the upright member 28, as best shown in FIG. 4. Alternatively, the retaining members 30 and 32 may extend at other angles with respect to the upright member 28, having an angle on the inside facing surfaces 44 and 60 less than ninety degrees. Such an arrangement would cause the retaining members 30 and 32 to even more strongly engage the shelf end wall 76 and hold the shelf against movement. Alternatively, more than two retaining members may be provided for each shelf clip if desired.

In other embodiments, the shelf clip 14 may include a separately formed and attached spring member which biases the retaining members 30 and 32 into contacting engagement with the end wall 76 of the shelf 12 to aid in holding the shelf in position. A nonslip pad or other device may also be used rather than the sharp knife-like edges shown in the preferred embodiment. While it is not necessary that the retaining members be integrally formed with upright member 28 to provide the retaining function, doing so significantly reduces manufacturing costs and provides for reliable operation.

The slots 34 and 36 are shown extending completely through upright member 28 to permit the retaining members 30 and 32 to be forced backward for a distance equal to the width of right member 28, until they contact the mounting wall 10. Alternatively, the slots may only extend partially through the upright member 28 and the retaining members 30 and 32 would be depressible into the slots, up to the extent of their depth.

Having the mounting post 18 positioned immediately behind retaining members 30 and 32 provides the advantage that a significant force applied by the shelf 12 against retaining members 30 and 32 is transferred to the upright member 28, and presses it firmly against mounting wall 10 to securely retain the mounting post 18 in position in the hole 16 into which it is inserted. This ensures that the upper mounting post 18 remains completely embedded in the hole 16 and prevents the upper portion of the upright member 28 from being pulled away from the mounting wall 10, even when significant weight is placed on the shelf 12. Such weight placed on the shelf 12 exerts a downward force on the support member 22 which is transferred by the gussets 72 and 74 to the lower portion of the upright portion 28 to also force the lower mounting post 20 firmly into the hole 16 in which it is inserted in the mounting wall 10.

With the shelf clip 14 of the present invention the shelf 12 provides a horizontal force to press the shelf clip against the mounting wall 10 and thus assists in holding itself up. The use of the shelf 12 to apply the force that tends to hold itself up provides significant advantages and allows the shelf to be maintained in the proper position over long periods of time. Since the mounting posts 18 and 20 are forced into the wall to prevent forward tilting movement or rotation of the shelf clip 14 under loading of the shelf, the holes 16 are not enlarged from movement of the clip and firmly hold the mounting posts in position. Because the retaining members 30 and 32 prevent lateral movement of the shelf, the minimized lateral movement of the shelf clip itself further increases the life of the shelf clip and the holes 16.

The use of resilient retaining members 30 and 32 provides another significant advantage in that mounting tolerances are less critical than with some prior art devices. In some prior art shelf clips, to function properly tolerances in shelf length must be closely adhered to. However, the shelf clip 14 of the present invention permits much looser tolerances to be used. The retaining members 30 and 32 need be only slightly depressed and will still provide the biasing force required to hold the shelf 12 in position. Because of the use of the slots 34 and 36 which allow the retaining members 30 and 32 to be depressed significantly more than required to hold the shelf 12 in place, all the way until contacting the mounting wall 10 if necessary, cutting the shelf 12 to a precise length is not so critical. Further, the use of the two mounting posts 18 and 20, in combination with the resiliently biased retaining members 30 and 32, provides a longer lasting shelf clip and prevents the degrading of holes 16 in the mounting wall 10 experienced with prior art devices.

In an alternative embodiment of the invention shown in FIG. 6, a shelf clip 14' has a single retaining member 100. This embodiment may most advantageously be used when a back edgewall 102 of the shelf 12 firmly abuts a fixed back wall 104 which prevents lateral movement relative to the shelf clip 14' in the rearward direction. The single retaining member 100 of the shelf clip 14' has a shape similar to that of the retaining member 30 of the shelf clip 14 of the first embodiment with the sharp knife-like edge 52 firmly engaging the shelf 12 to prevent lateral movement of the shelf in the forward direction, to ensure that the shelf does not move forward when an item is being forwardly removed from the shelf. A slot 106 is provided behind the retaining member 100. In all other significant respects, the alternative embodiment of FIG. 6 has the construction and function described above for the first embodiment and that description will not be repeated here.

I claim:

1. A clip for holding a shelf having an edgewall in a desired elevational position relative to a generally vertical mounting wall having a vertically extending series of spaced apart holes, comprising:

a body member having a front surface and a back surface, the body member being positionable in a generally vertical plane with the back surface in juxtaposition with the mounting wall;

a shelf support member attached to the body member and projecting forwardly beyond the front surface thereof to provide a generally horizontal support surface to hold the shelf up when the body member is positioned in juxtaposition with the mounting wall;

a pair of mounting posts attached to the body member and projecting rearwardly beyond the back surface thereof for removable insertion into a pair of holes corresponding to the desired elevational position for the shelf; and a pair of retaining members resiliently attached to the body member and projecting forwardly beyond the front surface thereof to present a vertical edge terminating in a position generally adjacent said shelf support member, to engage the shelf edgewall when the shelf is placed in position against the shelf support member with the shelf edgewall pressing the retaining members toward the body member and to apply a resilient biasing force against the shelf edgewall to inhibit lateral movement of the shelf.

2. The shelf clip according to claim 1 wherein one of the mounting posts extends from the body member from an elevational position immediately behind the retaining members and above the shelf support member.

3. The shelf clip according to claim 1 wherein the retaining members each have a sloped wall portion extending outward and downward from the body member to guide the shelf into a position wherein the retaining members apply the biasing force against the shelf edgewall as the shelf is lowered toward the shelf support member from above.

4. The clip according to claim 1 wherein a bottom region of said retaining members is adjacent said shelf support member.

5. The clip of claim 1 wherein each of the retaining members is resiliently coupled to the body member by a connecting portion of the retaining member and the retaining member extends generally along the front surface of the body member, and the body member has a pair of apertures therein each sized to receive one of the retaining members therein when pressed by the shelf edgewall toward the body member.

6. The clip of claim 5 wherein the apertures extend completely through the body member and permit depression of the retaining member until they engage the mounting wall.

7. The clip of claim 1 wherein the retaining members each have a tapered generally vertically extending edge when the body member is positioned in juxtaposition with the mounting wall to bite into the shelf edgewall and grasp the shelf edgewall against lateral movement, in at least one lateral direction.

8. The clip of claim 7 wherein the tapered edge of one of the retaining members prevents lateral movement of the shelf in one lateral direction and the tapered edge of the other retaining member prevents lateral movement of the shelf in the other direction.

9. A clip for holding a shelf having an edgewall in a desired elevational position relative to a mounting wall having a vertically extending series of spaced apart holes, comprising:

a body member having a front surface and a back surface the body member being positionable in a generally vertical plane with the back surface in juxtaposition with the mounting wall during use of the clip;

a shelf support member attached to the body member and projecting forwardly beyond the front surface thereof to provide a generally horizontal support surface to hold the shelf up during use of the clip;

at least one mounting post attached to the body member and projecting rearwardly beyond the back surface thereof for removable insertion into a desired one of the holes corresponding to the desired elevational position for the shelf; and retaining means for grasping the shelf edgewall when the shelf is in position on the support surface of the shelf support member during use of the clip to inhibit lateral movement of the shelf in at leas one lateral direction, the retaining means being attached to the body member and projecting forwardly beyond the front surface thereof, to present a vertical edge terminating in a position generally adjacent said shelf support member.

10. The clip of claim 9 wherein the retaining means includes at least one or more engagement members means for biting engagement with the shelf edgewall to hold the shelf against lateral movement in both lateral directions.

11. The clip according to claim 9 wherein a bottom region of said retaining members is adjacent said shelf support member.

12. The clip of claim 9 wherein the retaining means includes an engagement member means for resiliently engaging the shelf edgewall.

13. The clip of claim 12 wherein the engagement member means includes a sharp knife-like edge oriented generally vertically during use of the clip to bite into the shelf edgewall and hold the shelf against lateral movement in at least one lateral direction.

14. The clip of claim 12 wherein the retaining means further includes a sloped wall portion extending outward and downward from the body member to guide the shelf into a position with the engagement member engaging the shelf edgewall.

15. The clip of claim 12 wherein the engagement member means has a sharp portion which bites into the shelf edgewall during use of the clip and holds the shelf against lateral movement in at least one lateral direction.

16. The clip of claim 12 wherein the engagement member means is resiliently connected to the body member at a connector portion and has a rigid contact portion extending therefrom in a direction generally parallel to the body member, and the body member has a recess therein sized to freely receive the contact portion when the contact portion s engaged and pressed toward the body member by contact with the shelf edgewall.

17. The clip of claim 16 wherein the recess extends fully through the body member.

18. A shelf and a clip for holding said shelf, said shelf having an edgewall in a desired elevational position relative to a generally vertical mounting wall having a vertically extending series of spaced-apart holes, comprising:

a shelf;

a body member having a front surface and a back surface, the body member being positionable in a generally vertical plane with the back surface in juxtaposition with the mounting wall;

a shelf support member attached to said body member and projecting forwardly beyond the front surface of said body member to provide a generally horizontal support surface to hold said shelf when said body member is positioned in juxtaposition with the mounting wall;

post means attached to said body member and projecting rearwardly from the back surface of said body member for removable insertion into a hole corresponding to the desired elevational position for said shelf; and retaining means resiliently attached to said body member and projecting forwardly beyond the front surface of said body member and engaging said shelf edgewall when said shelf is placed in position for support by said shelf support member, the shelf edgewall pressing said retaining means toward said body member, said retaining means applying a resilient biasing force against said shelf edgewall to inhibit the lateral movement of said shelf.

19. The shelf and support clip according to claim 18 wherein said post means includes a post positioned above said shelf support member, said post means being biased into said wall by said retaining means and said shelf.

20. The clip according to claim 19 wherein a bottom region of said retaining means is adjacent said shelf support member.

* * * * *